United States Patent [19]

Sendel et al.

[11] Patent Number: 4,461,394

[45] Date of Patent: Jul. 24, 1984

[54] CLOSURE CAP AND CONTAINER

[75] Inventors: Uwe Sendel; Karl Nofer, both of Kitchener, Canada

[73] Assignee: Pano Cap (Canada) Limited, Kitchener, Canada

[21] Appl. No.: 435,686

[22] Filed: Oct. 21, 1982

Related U.S. Application Data

[63] Continuation-in-part of Ser. No. 088,515, Oct. 26, 1979, abandoned.

[51] Int. Cl.[3] ..... B65D 41/04

[52] U.S. Cl. ..... 215/330

[58] Field of Search ..... 215/330, 217, 31

[56] References Cited

U.S. PATENT DOCUMENTS

| | | | |
|---|---|---|---|
| 3,682,345 | 8/1972 | Baugh | 215/330 |
| 3,741,421 | 6/1973 | Wittner | 215/217 |
| 4,053,077 | 10/1977 | De Felice | 215/217 |
| 4,084,716 | 4/1978 | Bogert | 215/217 |
| 4,139,112 | 2/1979 | Cooke | 215/217 |

*Primary Examiner*—Donald F. Norton

*Attorney, Agent, or Firm*—Daryl W. Schnurr

[57] ABSTRACT

This invention relates to a closure cap, a container and to a closure cap and corresponding container in combination. As shown in FIG. 1 of the drawings, screw threads 14, 22 of a cap 2 and container 4 respectively each have sufficient alternate ridges 16, 27 and indentations 18, 28 over at least part of their length so that when the cap 2 and container 4 are in a closed position, at least one ridge on one screw thread can engage an indentation on the other screw thread. In another embodiment of the invention as shown in FIGS. 8 and 9, the screw thread of the cap is formed by a series of rounded projections 68 that are located adjacent to one another and overlap slightly with one another. The rounded projections 68 have a series of alternating rounded ridges and adjacent indentations.

9 Claims, 13 Drawing Figures

CLOSURE CAP AND CONTAINER

BACKGROUND OF THE INVENTION

The present application is a continuation-in-part of prior copending application, Ser. No. 06/088,515 filed Oct. 26, 1979 and now abandoned.

1. Field of the Invention

This invention relates to a closure cap and to a container and to a closure cap and corresponding container in combination.

2. Description of the Prior Art

It is known to have closure caps and corresponding containers having continuous or intermittent screw threads to engage each other when the cap and the container are in a closed position. However, after the container has been filled with product and the cap has been affixed, the containers are shipped to various wholesale and retail outlets and are subjected to vibration during transit and handling. This vibration and general movement sometimes causes the cap to backoff from the container, thereby subjecting the product to the risk of contamination, or the inner parts of the container become soiled and the product becomes unsaleable.

It is an object of the present invention to provide a cap and corresponding container that can be opened and closed in the same manner as a cap and container with standard screw threads, but will not open or back off because of vibration or other movement during transit.

SUMMARY OF THE INVENTION

This invention relates to a closure cap for use with a corresponding container having a neck surrounding an opening with said neck having a screw thread on its outer surface has a central portion and a periphery with a flange extending from the periphery for contacting said container. The flange has a series of rounded projections on its inner surface. The projections are located adjacent to one another and overlap slightly with one another to form a screw thread having a series of similar alternate rounded ridges and adjacent indentations. The screw thread of the container contains corresponding projections over part of its length. The screw thread of the cap contains sufficient projections so that when the cap and container are in a closed position, at least one ridge on one screw thread can engage an indentation on another screw thread.

In a further embodiment, a closure cap and corresponding container in combination have a cap with a central portion and a periphery with a flange extending from said periphery. The container has a neck surrounding an opening with a screw thread on an outer surface of said neck. The flange of the cap has a series of rounded projections on its inner surface. These projections are located adjacent to one another and overlap slightly with one another to form a screw thread having a series of similar alternate rounded ridges and adjacent indentations. The screw thread of the container contains alternate ridges and indentations. The screw thread of the cap contains sufficient alternate ridges and indentations so that, when the cap and container are in a closed position, at least one ridge on one screw thread can engage an indentation on another screw thread.

BRIEF DESCRIPTION OF THE DRAWINGS

In the accompanying drawings, which illustrate a preferred embodiment of the invention.

DESCRIPTION OF A PREFERRED EMBODIMENT

Figure 1:
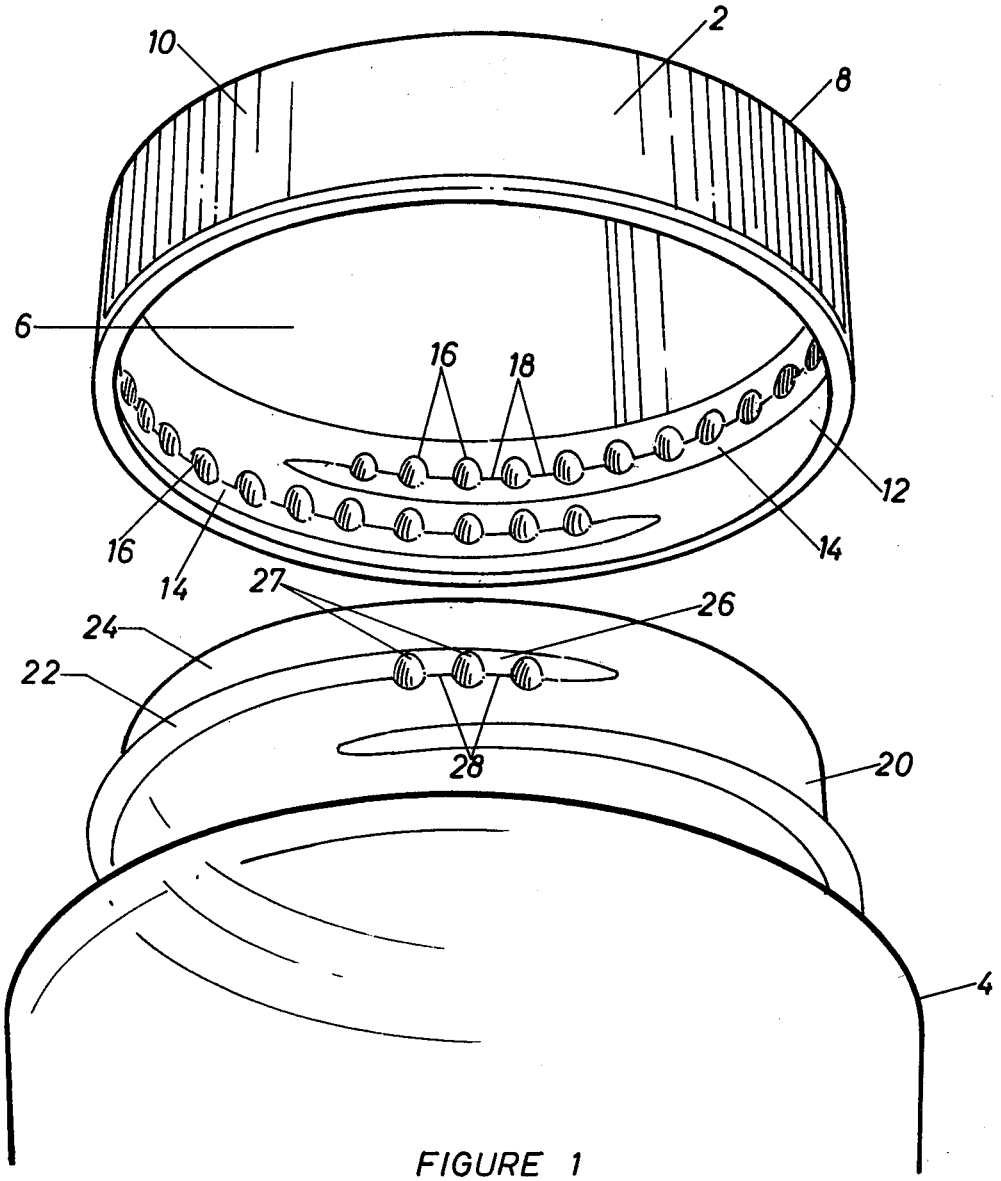
FIG. 1 is a partial perspective view of the cap and container of the present invention in an open position with the cap located above the container.

Referring to the drawings in greater detail, in FIG. 1, a closure cap 2 is located immediately above a corresponding container 4. The closure cap 2 has a central portion 6 and a periphery 8 with a flange 10 extending from the periphery. On the inner surface 12 of the flange 10, there is located a continuous screw thread 14 (only part of which is shown). The screw thread 14 has a series of alternate ridges 16 and indentations 18 located over its length. The series of ridges 16 and indentations 18 could be intermittent rather than continuous over the screw thread or there could be one series located over only a part of the screw thread.

The container 4 has a neck 20 with a continuous screw thread 22 located on an outer surface 24 of the neck 20. The screw thread 22 corresponds to the screw thread 14 but contains two groups 26 (only one of which is shown), the ridges and indentations each having three ridges 27 and two adjacent indentations 28. The two groups 26 are located on the screw thread 22 approximately 180 degrees apart from one another. The ridges 16 and indentations 18 are located on the upper portion of the screw thread 14 and the ridges 27 and indentations 28 being located on the lower portion of the screw thread 22. When the cap 2 is placed over the neck 20 of the container 4 and the cap 2 is rotated to a closed position relative to the container 4, the indentations 18 of the cap 2 are engaged by the ridges 27 of the container 4 and the ridges 16 of the cap 2 can engage the indentations 28 of the container 4. It can readily be seen that the ridges are rounded so that the cap can be removed from the container simply by turning it in an appropriate direction. In other words, it is not necessary or desirable to apply any axial pressure in order to remove the cap. The cap can be removed in the same manner as a cap and container with standard screw threads. Further, the caps and containers are particularly desirable for preserving or protecting food items. As the cap and container often have a relatively large diameter, it would be very difficult to manually apply an axial pressure at the periphery of the cap, if such pressure was required to open or close the cap and container.

The ridges 16 of the cap 2 of FIG. 1 have a width approximately equal to the width of the indentations 18. Similarly, the ridges 27 of the container 4 have a width approximately equal to the width of the indentations 28. Also, the ridges 16 and indentations 18 of the cap 2 have a width approximately equal to that of the ridges 27 and indentations 28 of the container 4. Preferably, the screw thread of the cap has a continuous series of indentations and ridges over its length while the screw thread of the container has only two groups of indentations and ridges, each having three ridges and two adjacent indentations. The two groups are preferably spaced approximately 180 degrees apart from one another. The series of indentations and ridges on the screw thread of the cap could be intermittent or continuous. The series of indentations and ridges on the screw thread of the container could likewise be intermittent or continuous. So long as there are a sufficient number of alternate indentations and ridges on each of the screw threads of the cap and container so that, when the cap is in a closed position, at least one ridge on one screw thread can engage an indentation on the other screw thread, any combination of intermittent or continuous series of ridges and indentations can be used. Also, the screw threads themselves could be intermittent or continuous.

Thus, once the cap 2 and the container 4 are in a closed position, the cap 2 will not back-off or move any appreciable peripheral distance relative to the container 4 when the cap and container are vibrated during transit and handling.

Figure 2:
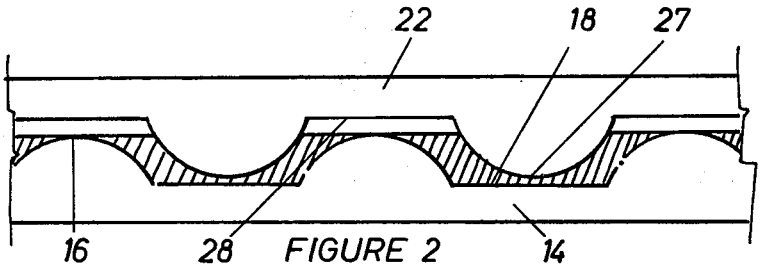
FIG. 2 is a partial schematic view of a screw thread of the cap and container in a closed position.
Figure 3:
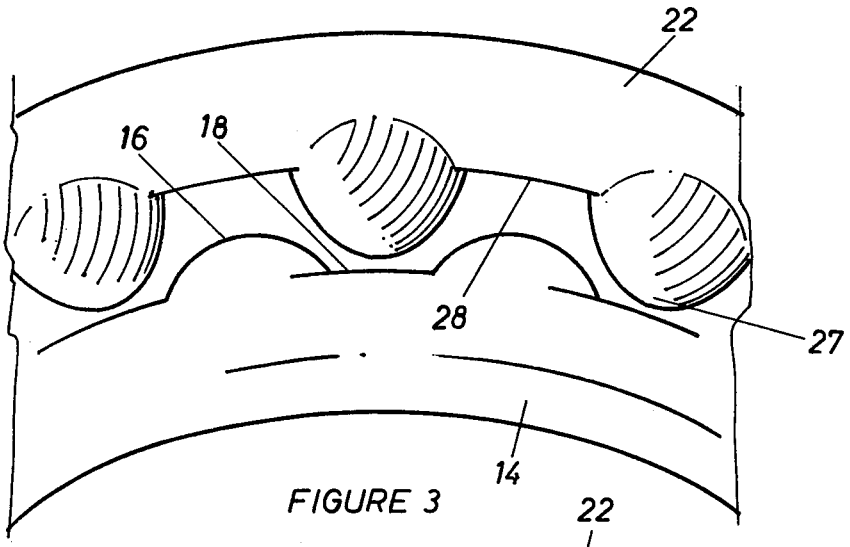
FIG. 3 is a partial perspective view of ridges and indentations in the screw threads of both the cap and container.
Figure 4:
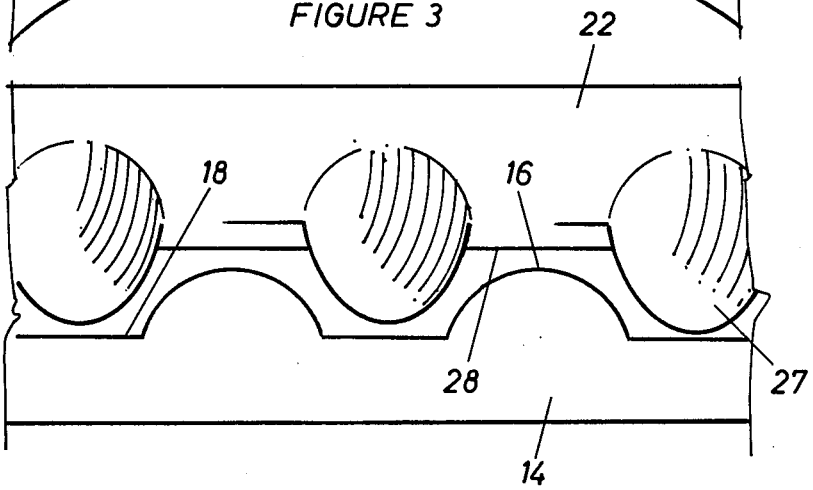
FIG. 4 is a side view of the ridges and indentations of FIG. 3.

In FIG. 2, the screw thread 14 of the cap is shown in a closed position relative to the screw thread 22 on the container with ridges 16 engaged in an indentation 28. Similarly, a ridge 27 of the screw thread 22 engages an indentation 18 of the screw thread 14. In FIGS. 2, 3 and 4, it should be noted that the distance between adjacent ridges of both screw threads is exaggerated for ease of illustration. Also, the ridges and indentations are shown out of actual contact for the same reason.

FIG. 3 is very similar to FIG. 2 except that the screw threads are shown in perspective.

It is possible when the cap is closed on the container 4 that the ridges on the screw thread of the cap will engage the ridges on the screw thread of the container. In addition, the indentations on the cap and container will be located immediately opposite to one another. While this position is not desirable, it will occur, particularly when the cap is tightened onto the container by machine. When this occurs, the cap may back-off slightly relative to the container as the result of vibrations during transit or otherwise to the point where the ridges 16 of the cap 2 engage the indentations 28 of the container 4 and vice-versa. As the ridges are immediately adjacent to the indentations on each of the screw threads 14, 22, the cap 2 will move only half the distance between consecutive ridges 16 of the screw thread 14 before the ridges 16 are properly engaged with the indentations 28. Generally, the backing-off movement will be so miniscule that a safe seal will still be maintained and no contamination or spoiling of the product located within the container will result. The degree of tightness of the cap on the container can be controlled and regulated by the amount of torque applied by the capping machine.

Of course, sometimes the cap will engage the container in a closed position where the ridges of the cap and container engage one another but are not directly opposite. This will also results in a slight backing-off of the cap relative to the container to the point where the ridges engage the immediately adjacent indentations. Again, this slight backing-off should not result in any contamination or spoiling of any product located within the container.

Figure 5:
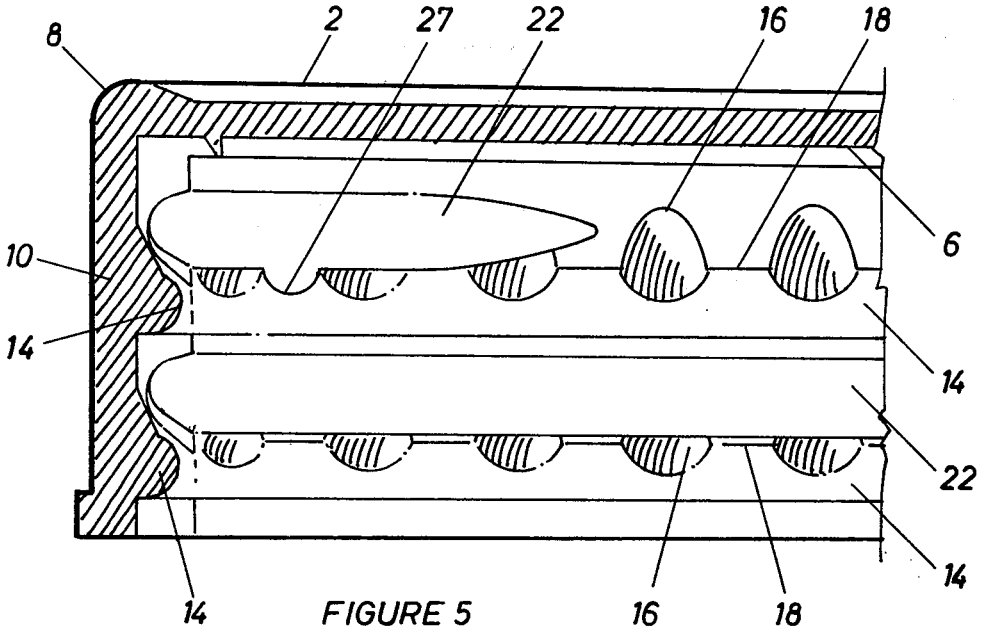
FIG. 5 is a partial side view of a cap on a container in a closed position with the central portion and periphery of the cap partially cut away to expose the screw threads.

In FIG. 4, there is shown a side view of the two screw threads in a closed position. Indentations 18, 28 and ridges 16, 27 of the cap and container respectively all have approximately equal widths. In FIG. 5, the cap and container are in a closed position with some of the indentations 18 on the screw thread 14 of the cap 2 engaged by the ridges 27 on the screw thread 22 of the container 4 and the indentations 28 on the screw thread 22 of the container 4 are engaged by the ridges 16 on the screw thread 14 of the cap 2.

The indentations 18, 28, as shown in FIGS. 1 to 5, are created by the formation of the ridges 16, 27. In other words, the indentations 18, 28 are created by "adding" the ridges 16, 27 to the screw threads 14, 22 rather than by "cutting" into the screw threads 14, 22. There is no "addition" or "cutting" made to the screw threads 14, 22 to create the indentations 18, 28. The cross-sections of the screw threads 14, 22 through the indentations 18, 28 are the same as the cross-sections of these screw threads before the ridges 16, 27 are "added". Of course, the ridges could be created in a similar manner by cutting indentations into appropriate screw threads. Or, the ridges and indentations could be created partially by cutting into appropriate screw threads and partially by adding on to appropriate screw threads. The manner of creating the indentations and ridges will be readily apparent to those skilled in the art. Again, for ease of illustration, the space between adjacent ridges of the cap and container is shown as being much greater than that which exists in actual use.

Returning to FIGS. 2 and 3, the cross-section of the screw thread 22 as shown in FIG. 2 is the same as that of a standard screw thread without ridges or indentations. Similarly, the cross-section of the screw thread 14 as shown in FIG. 3 is the same as that of a standard screw thread without ridges or indentations. In FIG. 3, the cross-section of a lower portion 51 of the screw thread 22 is the same as that of a standard screw thread as there is no ridge at this point on the screw thread 22.

Figure 6:
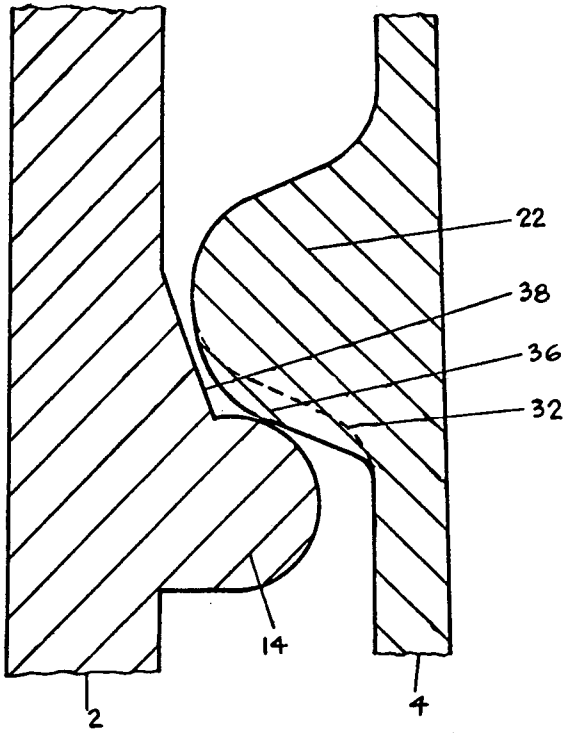
FIG. 6 is a magnified schematic partial sectional view of a ridge of the container engaged in an indentation of the cap.

Referring to FIG. 6 in greater detail, a ridge 36 on a screw thread 22 of a container 4 is shown engaged in an indentation 38 of a screw thread 14 of a cap 2. There is also shown, by means of a dotted line, the cross-sectional shape of an indentation 32 immediately behind and adjacent to the ridge 36. The cross-section of the screw thread 14 as shown in FIG. 8 is the same as that of a standard screw thread for a plastic cap.

Figure 7:
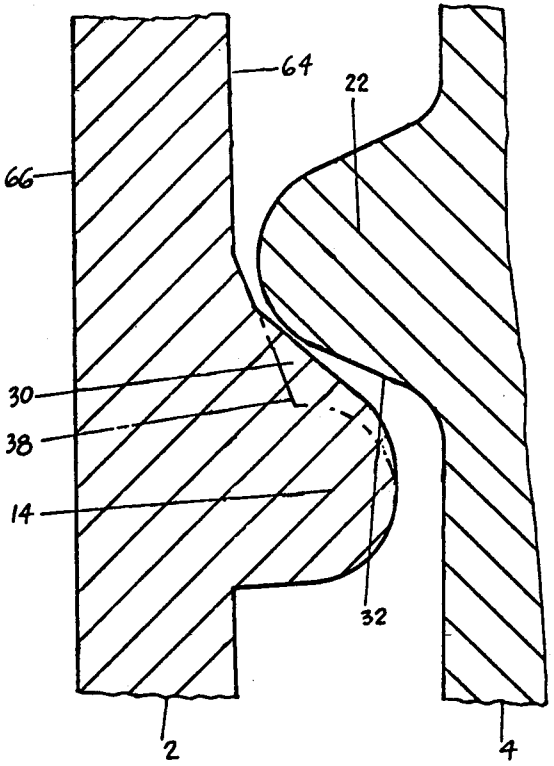
FIG. 7 is a magnified schematic partial sectional view of a ridge of the cap engaged in an indentation of the container.

Referring to FIG. 7 in greater detail, there is shown a ridge 30 on a screw thread 14 of a cap 2 engaged in an indentation 32 on a screw thread 22 of a container 4. There is also shown by means of a dotted line, an indentation 38 immediately behind and adjacent to the ridge 30 on the screw thread 14. The cross-section of the screw thread 22 is the standard cross-section for screw threads of plastic or glass containers.

The results of the present invention can be achieved with ridges and indentations of various sizes and shapes. It was found that satisfactory results could be obtained for container diameters ranging from 18 millimeters to 132 millimeters by having ridges on the cap and containers with a depth of 0.3 millimeters, at their centre, the ridges being arcuate in cross-section and the distance between centres of adjacent ridges being 2.5 millimeters. The depth of the ridge 30 on the screw thread 14 of the cap 2 as shown in FIG. 7 increases beyond 0.3 millimeters as it is tapered at an angle of 45 degrees relative to the inner surface 64 of the flange 66. This tapered portion allows the cap 2 to be stripped from a mold during manufacture without damaging the ridges or screw thread.

Figure 8:
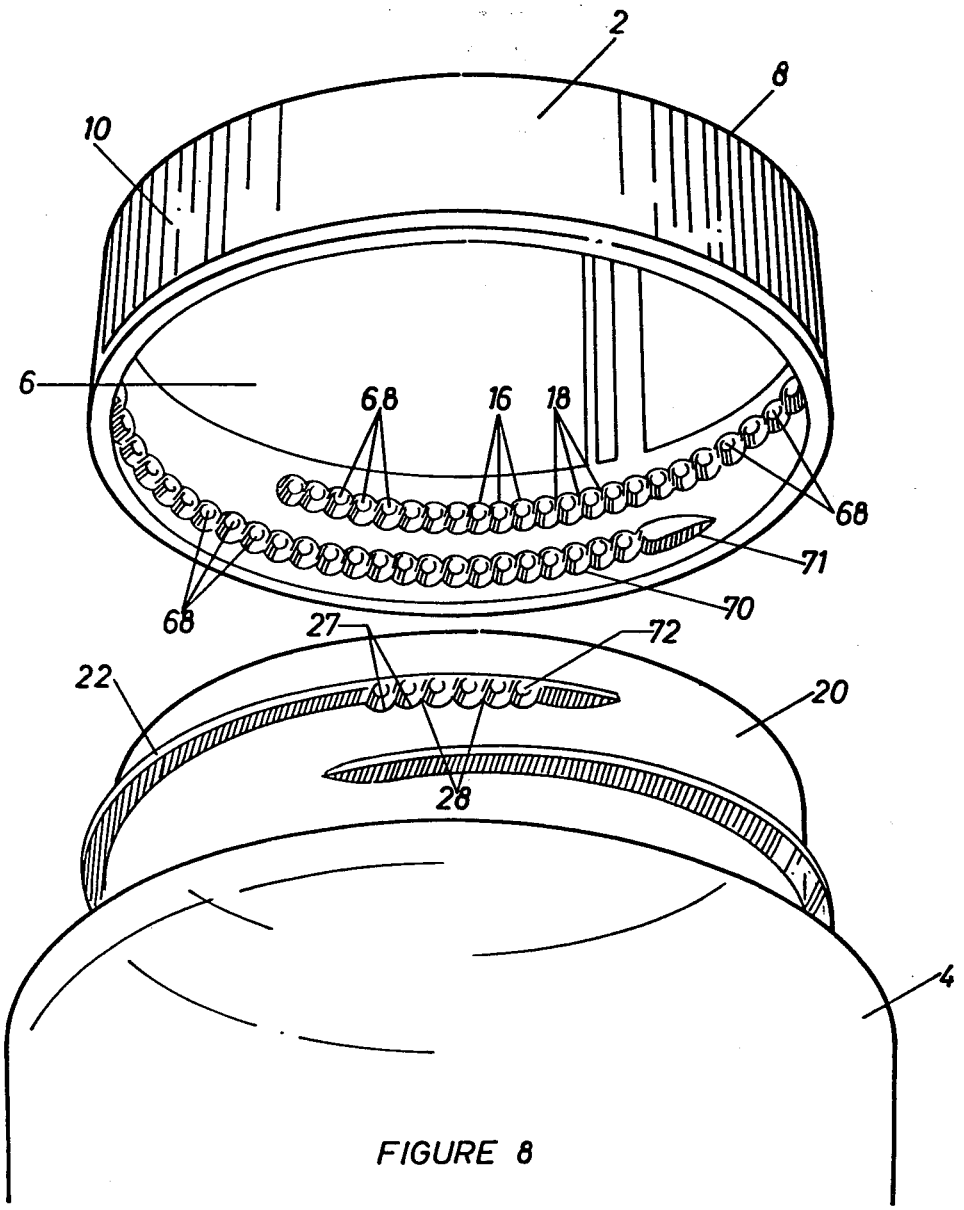
FIG. 8 is a perspective view of a further embodiment of the invention showing a cap and part of a container where the screw thread of the cap is made up of a series of adjacent and slightly overlapping projections.

In FIG. 8, there is shown a further embodiment of the invention. Instead of having alternating ridges and indentations on a screw thread as shown in the various embodiments of FIGS. 1 to 7, the embodiment shown in FIG. 8 has a cap 2 with a series of symmetrical rounded projections 68 on an inner surface of a flange 10. The projections 68 are adjacent to one another and overlap slightly with one another to form a screw thread 70. The projections 68 have a series of identical rounded ridges 16 and adjacent indentations 18 located between said ridges 16. While the ridges 16 are rounded, the indentations 18 are V-shaped. At a starting end 71 of the screw thread 70, the end 71 is tapered so that the cap will turn smoothly onto the container. The projections 68 are in the shape of slightly overlapping truncated cones. Various other shapes, for example, hemispheres, will be readily apparent to those skilled in the art.

Also shown in FIG. 8, is a container 4 with a neck 20 and screw thread 22. Over part of the length of the screw thread 22, there are a series of partial projections 72. The partial projections 72 are located in a lower portion of the screw thread 22. The partial projections 72 have alternating ridges 27 and indentations 28. When the cap 2 is in a closed position relative to the container 4, some of the ridges 16 engage with the indentations 28 and the ridges 27 engage with some of the indentations 18. This will be discussed in more detail below. Preferably, the distance between centres of adjacent ridges is 2.5 millimeters.

Figure 9:
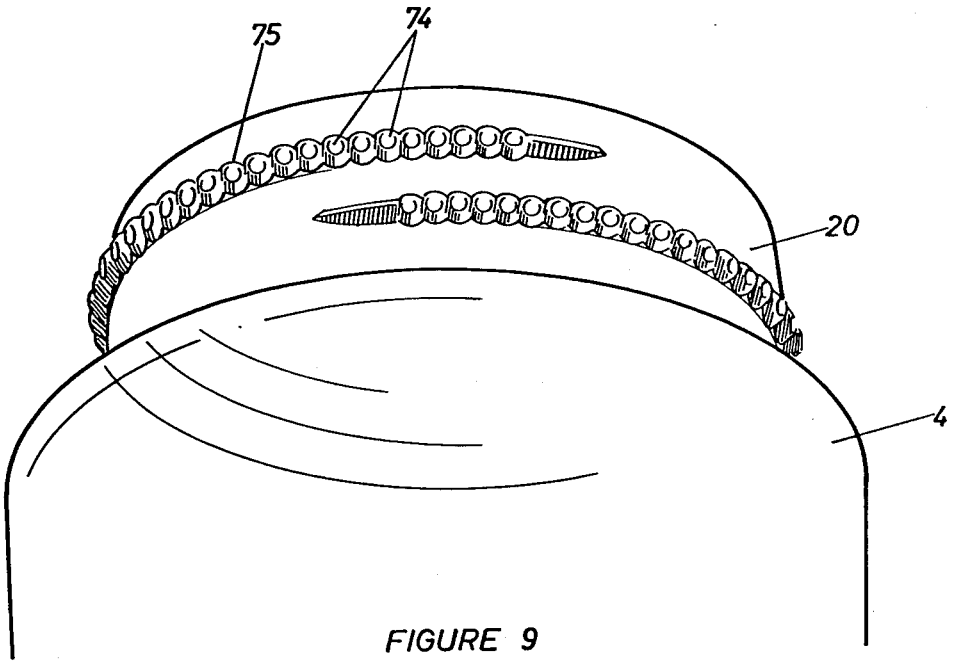
FIG. 9 is a perspective view of another embodiment of a container wherein the adjacent projections on the container are identical to those in the cap of FIG. 8.

Referring to FIG. 9 in greater detail, the cap is not shown but would be identical to that shown in FIG. 8. However, projections 74 on the screw thread 75 of the container 4 are different from the projections 72 shown in FIG. 8. The projections 74 are identical to the projections 68 of the screw thread 70 in that they are arranged to form the actual screw thread. Of course, the screw thread 75 could have projections 74 making up only part of its length. The screw thread 75 could have two groups of projections 74 similar to the screw thread 27 of FIG. 8 except that the projections would be identical to the projections 68. The projections 72 are not identical to the projections 68 but are only partial projections.

Figure 10:
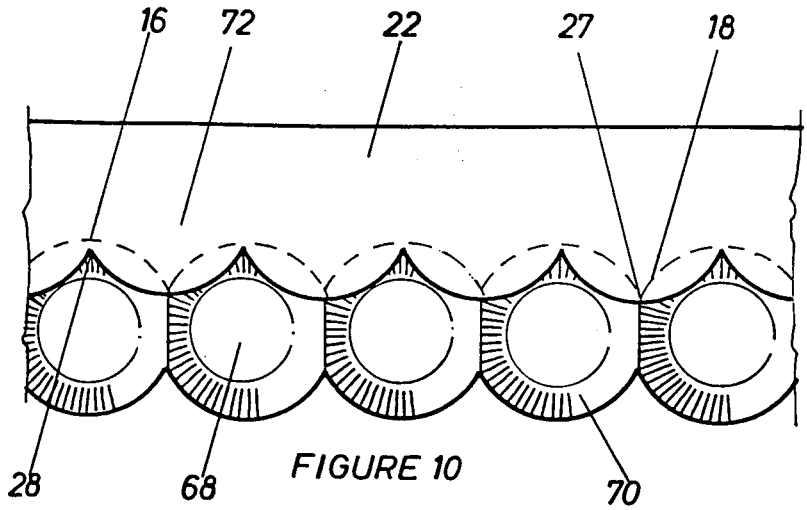
FIG. 10 is a partial sectional side view of adjacent projections on the cap engaged with similar projections on the container.

In FIG. 10, there is shown a schematic side view of the partial projections 72 of the screw thread 22 and the projections 68 that form the screw thread 70 of the cap 2. As can be seen, the ridges 16 of the cap are engaged with the indentations 28 of the container. Also, the ridges 27 of the cap are engaged with the indentations 18 of the container. In other words, the cap and container are shown in a closed position.

Figure 11:
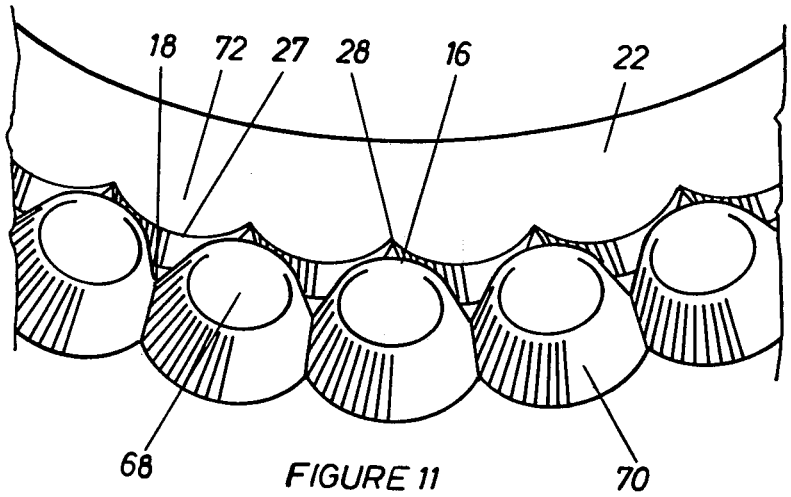
FIG. 11 is a partial perspective view of adjacent projections on a cap engaged with similar projections on a container.
Figure 12:
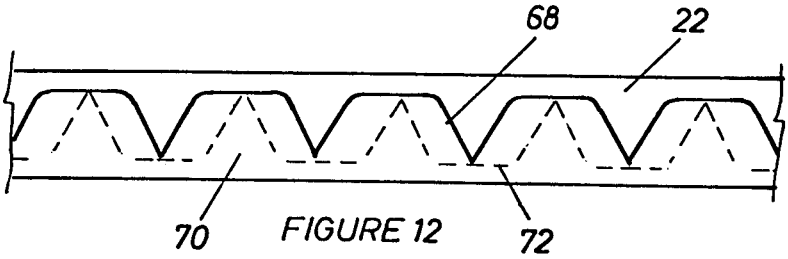
FIG. 12 is a partial schematic side view of adjacent projections.

In FIG. 11, there is shown a partial perspective view of the engagement of the ridges and indentations of the cap and container in a closed position. In FIG. 12, there is shown a schematic side view of the projections 68 of the cap 2.

Figure 13:
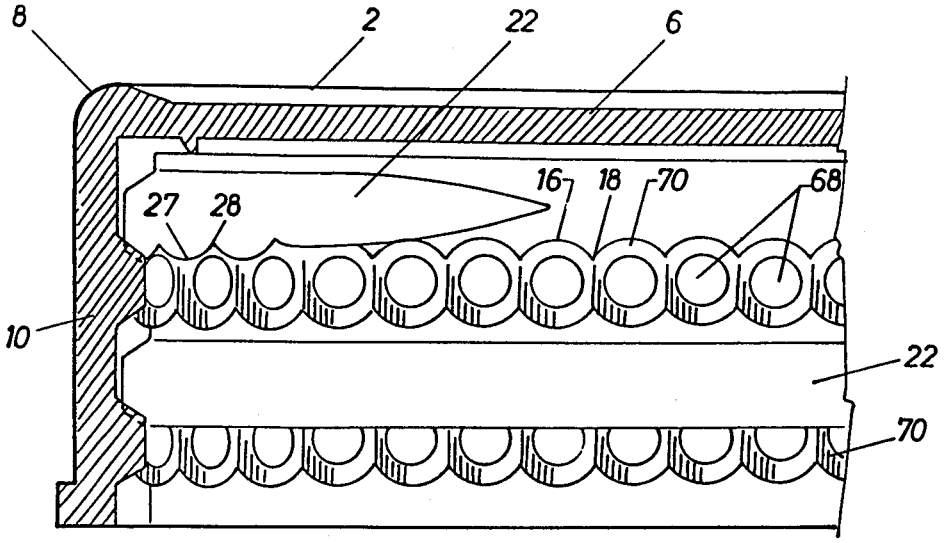
FIG. 13 is a partial side view of a cap on a container in a closed position with the central portion and periphery of the cap partially cut away to expose the screw threads.

In FIG. 13,there is shown an additional view of the cap 2 in a closed position onthe container 4. The cap 2 and neck 20 are partially cut away so that the thread 70 of the cap and the thread 22 of the container can be seen when the cap and container are in a closed position.

Preferably, the closure cap is made of plastic and the container is made of glass or injected or blow-molded plastic. Poly propylene is an example of a type of plastic that can be used. Other suitable materials for the cap or container will become readily apparent to those skilled in the art. The screw threads of the cap and container of the present invention may be continuous or intermittent so long as the ridges and indentations are located over a sufficient portion of the length of the screw thread so that at least one ridge on one screw thread can engage an indentation on the other screw thread when the cap and container are in a closed position. It is possible to have an intermittent screw thread on the cap and a continuous screw thread on the container or vice-versa or a suitable combination thereof. It is possible to have only one ridge on one screw thread and only one indentation on the other screw thread so long as the one ridge can engage the one indentation when the cap and container are in a closed position.

The second embodiment shown in FIGS. 8 to 13 is easier to construct than the first embodiment shown in FIGS. 1 to 7. The mold for the cap of the second embodiment can be more easily constructed because the screw thread consists of a series of identical projections. With the first embodiment, a standard screw thread must be cut into the mold first. As a second step, the ridges are cut into the mold.

When a cap is turned onto a container so that the two screw threads contact, the ridges of the cap engage with indentations of the container and vice-versa. To turn the cap onto the container, it is not necessary to apply any axial force. To remove the cap from a container, it is not necessary to apply any axial force. The cap can be applied to or removed from the container simply by applying lateral pressure in an appropriate direction. While it is recognized that any lateral force will have an axial component, when the phrase "simply by turning it in an appropriate direction" is used in this specification, it means that no axial pressure or force is required to be applied in order to remove the cap from the container.

One advantage of the present invention is that a cap having a screw thread containing indentations and ridges can be used efficiently with a container having a normal screw thread without indentations and ridges and vice versa. Thus, caps on containers made in accordance with this invention are interchangeable with caps on containers having normal screw threads without indentations or ridges.

What we claim as our invention is:

1. A closure cap for use with a corresponding container having a neck surrounding an opening, said neck having a screw thread on its outer surface, said screw thread of the container having alternate ridges and indentations, said cap comprising a central portion and a periphery with a flange extending from the periphery for contacting said container, said flange having a series of rounded projections on its inner surface, said projections being located adjacent to one another and overlapping slightly with one another to form a screw thread having a series of similar alternate rounded ridges and adjacent indentations, the screw thread of the cap containing sufficient alternate ridges and indentations so that when the cap and container are in a closed position, at least one ridge on one screw thread can engage an indentation on another screw thread.

2. A closure cap as claimed in claim 1 wherein a leading end of the screw thread of the cap is tapered to guide the cap onto the container.

3. A closure cap as claimed in claim 1 wherein centres of adjacent projections are approximately 2.5 millimeters apart.

4. A closure cap as claimed in claim 1 wherein the projections are overlapping truncated cones.

5. A closure cap and corresponding container in combination comprising a cap having a central portion and a periphery with a flange extending from said periphery, and a container having a neck surrounding an opening with a screw thread on an outer surface of said neck, said flange having a series of rounded projections on its inner surface, said projections being located adjacent to one another and overlapping slightly with one another to form a screw thread having a series of similar alternate rounded ridges and adjacent indentations, the screw thread of the container containing alternate ridges and indentations, the screw thread of the cap containing sufficient alternate ridges and indentations so that, when the cap and container are in a closed position, at least one ridge on one screw thread can engage an indentation on another screw thread.

6. A closure cap and corresponding container in combination as claimed in claim 5 wherein the alternating ridges and indentations on the screw thread of the container are a series of rounded projections similar to those on the cap.

7. A closure cap and corresponding container in combination as claimed in claim 6 wherein the projections on the container are divided into two groups approximately 180 degrees apart.

8. A closure cap and corresponding container in combination as claimed in claim 5 wherein the ridges and indentations on the screw thread of the container are projections identical to those on the cap.

9. A closure cap and corresponding container in combination as claimed in claim 8 wherein the projections on the screw thread of the container are divided into two groups approximately 180 degrees apart.

* * * * *